US006315631B1

(12) United States Patent
Beckman et al.

(10) Patent No.: US 6,315,631 B1
(45) Date of Patent: Nov. 13, 2001

(54) METHOD OF GENERATING DUAL TRACK SOUNDS FOR AN ELECTRONIC TOY

(75) Inventors: Ralph Beckman, Providence; John Murphy, N. Scituate; Kipp Bradford; Stephen Schwartz, both of Providence; Henry Sharpe, III, Saunderstown, all of RI (US)

(73) Assignee: Design Lab, LLC, Providence, RI (US)

( * ) Notice: Subject to any disclaimer, the term of this patent is extended or adjusted under 35 U.S.C. 154(b) by 0 days.

(21) Appl. No.: 09/500,090

(22) Filed: Feb. 8, 2000

Related U.S. Application Data

(62) Division of application No. 09/335,537, filed on Jun. 18, 1999.

(51) Int. Cl.[7] ..... A63H 3/28

(52) U.S. Cl. ..... 446/297; 446/301; 446/299

(58) Field of Search ..... 446/298, 299, 446/300, 301, 330, 337, 338, 339, 369, 371, 404, 297; 434/307 A, 157; 84/600, 609–614

(56) References Cited

U.S. PATENT DOCUMENTS

| | | | | |
|---|---|---|---|---|
| 3,125,826 | * | 3/1964 | Ostrander | 446/118 |
| 3,210,887 | * | 10/1965 | Glass et al. | 446/118 |
| 3,583,093 | * | 6/1971 | Glass et al. | 446/117 |
| 4,516,950 | * | 5/1985 | Berman et al. | 446/297 |
| 4,799,171 | * | 1/1989 | Cummings | 364/513.5 |
| 4,809,335 | * | 2/1989 | Rumsey | 381/53 |
| 4,846,693 | * | 7/1989 | Baer | 434/308 |
| 4,923,428 | * | 5/1990 | Curran | 446/175 |
| 4,949,327 | * | 8/1990 | Forsee et al. | 369/58 |
| 5,004,442 | * | 4/1991 | Lemelson | 446/302 |
| 5,180,307 | * | 1/1993 | Hiramatsu | 434/157 |
| 5,273,443 | * | 12/1993 | Kaminski | 434/169 |
| 5,468,172 | * | 11/1995 | Basile | 446/299 |
| 5,486,872 | * | 1/1996 | Moon | 348/564 |
| 5,511,980 | * | 4/1996 | Wood | 434/169 |
| 5,608,700 | * | 3/1997 | Ikeda | 369/24 |
| 5,651,716 | * | 7/1997 | Mowrer et al. | 446/301 |
| 5,695,381 | * | 12/1997 | Truchsess | 446/297 |
| 5,820,440 | * | 10/1998 | Truchsess | 446/305 |
| 6,012,961 | * | 1/2000 | Sharpe, III | 446/298 |
| 6,066,025 | * | 5/2000 | Wisniewski | 446/410 |

* cited by examiner

*Primary Examiner*—Jacob K. Ackun, Jr.
*Assistant Examiner*—Kurt Fernstrom
(74) *Attorney, Agent, or Firm*—Barlow, Josephs & Holmes, Ltd.

(57) ABSTRACT

A toy figure has a movable mouth coupled to an actuator in the belly area. A speech generator stores sound elements for an entire song, verse, or nursery rhyme. The speech generator is provided with a first track of sequenced sound elements (singing version) that form a song when sequentially generated, and a related second track of a like number of sequenced sound elements (humming version). Sound elements from the first and second tracks are interchangeable at any given point during sequential output thereof. A switch located in the mouth is connected to the speech generator to provide input as to the mouth position, i.e. open or closed. Squeezing the belly of the figure opens the mouth, changing the state of the switch and initiating an output sequence from the speech generator. When the mouth is open, the child is able to easily control the mouth position by varying the pressure on the belly actuator. The speech generator checks the state of the mouth switch at given intervals. If the speech generator senses that the mouth is closed, the speech generator switches tracks to begin output of the next corresponding "bumming" segment of the song. The speech generator continues to check the state of the switch, and if the switch is then reopened, the toy begins to sing again at the same point within the sequenced output.

26 Claims, 9 Drawing Sheets

METHOD OF GENERATING DUAL TRACK SOUNDS FOR AN ELECTRONIC TOY

CROSS-REFERENCE TO RELATED APPLICATION

This application is a divisional application of U.S. Ser. No. 09/335,537, filed Jun. 18, 1999.

BACKGROUND OF THE INVENTION

The instant invention relates to toys, and more particularly to an electronic toy figure that generates sound responsive to manual manipulation of the toy.

Toy figures that generate a predetermined word string or sound upon actuation of a switch are well known in the art. Typically, once the switch is actuated the toy will execute a program and an entire sound sequence or word string will be generated responsive to the single input, i.e. change of state, from the switch. Toy figures which segment the sound elements into smaller elements and require repeated switch inputs to force the toy to continue to output the sound are also known in the art. In this regard, the Truchsess U.S. Pat. No. 5,695,381 is the closest prior art to the subject invention of which the applicant is aware. Truchsess discloses a toy figure which sings a nursery song when bounced. The toy figure includes a sound generator which stores a sequence of sound elements that, when sequentially generated, form a song. The rump area of the doll is provided with a contact switch which is connected to the sound generator and when the toy figure is repeatedly bounced on its rump the switch repeatedly changes state generating the sequential output of the sound elements.

While the existing toy design is particularly effective and amusing for younger children having only gross motor skills, the toy is not particularly engaging for older children who have better developed fine motor skills. Accordingly, there is a perceived consumer demand for new and improved toys which require more moderately sophisticated user input and which function in new amusing ways.

SUMMARY OF THE INVENTION

The instant invention provides an improved technology that allows a child to more easily control the sound output and motion of a toy figure to achieve convincing and coordinated sound effects without highly sophisticated motor skills. A toy figure constructed in accordance with the invention has a movable mouth coupled to an actuator in the belly area of the figure. The actuator permits proportional movement of the mouth to simulate speech by squeezing the belly actuator. A speech generator in the toy stores sound elements for an entire song, verse, nursery rhyme, joke or other utterances. The content is preferably divided into small syllable level chunks and can comprise any vocalization or sound output that incorporates an instinctive, inherent rhythm. In some cases, the content may be divided at the word level depending on cadence and rhythm of the output. More specifically, the speech generator is provided with a first track (singing track) of sequenced sound elements that form a recognizable sound recitation, such as a nursery rhyme or song, when sequentially generated, and is further provided with a second track (humming track) of a like number of sequenced sound elements also forming a recognizable sound recitation, such as a humming version of the same nursery rhyme or song, when sequentially generated. The second track is closely related to the first track such that sound elements from the first and second tracks are interchangeable at any given point during sequential output thereof.

The toy further includes a switch, i.e. state device. The switch is connected to the speech generator to provide input as to the mouth position, i.e. open or closed. In operation, the character begins to talk or sing when its belly is first squeezed. The squeezing action operates a coupling mechanism that opens the characters mouth, which in turn changes the state of the switch and initiates an output sequence from the speech generator. When the mouth is open, the child is able to easily control and vary the character's mouth position by varying the pressure on the belly actuator, thus mimicking the speech output generated by the speech generator. The speech generator checks the state of the mouth switch after a sound element is output. If the speech generator senses that the mouth is closed, the speech generator pauses and then rechecks the switch. If the mouth is still closed after the pause, the sound generator switches tracks to begin output of the next corresponding humming segment of the song. In other words, the toy automatically stops singing and begins humming. This audio behavior is synchronized with the open and closed state of the mouth. The speech generator continues to periodically check the state of the switch, and if the mouth is reopened, the sound generator switches back to the singing track and the character begins to sing again at the same point within the sequenced output. Since the tracks are interchangeable, the output appears as a continuous natural stream of singing and humming of the same song. If the switch is maintained in a closed position for an extended period of time, the speech generator will automatically reset the program sequence to the beginning. Other configurations for initiating output, for pausing output, and for requiring certain toy movements are also possible.

Other embodiments, such as interchangeable music and singing, or overlapping singing and music are also contemplated.

Accordingly, among the objects of the instant invention are: the provision of an electronic toy that allows a child to more easily control the sound output and motion of a toy figure to achieve convincing and coordinated sound effects without highly sophisticated motor skills; the provision of an electronic toy which automatically switches between parallel tracks of sound elements responsive to the state of an input switch; the provision of an electronic toy figure having a movable mouth assembly coupled to an actuator in the belly area of the figure, wherein the actuator permits proportional movement of the mouth to simulate speech by squeezing the belly actuator; the provision of such an electronic toy figure wherein a switch is located in the mouth of the toy to provide input as to the position of the mouth; the provision of such an electronic toy wherein the speech generator is provided with a first track of sequenced sound elements that form a recognizable sound recitation, such as a nursery rhyme or song, when sequentially generated, and is further provided with a second track of a like number of sequenced sound elements also forming a recognizable sound recitation, such as a humming version of the same nursery rhyme or song, when sequentially generated; and the provision of such an electronic toy wherein the second track is closely related to the first track such that sound elements from the first and second tracks are interchangeable at any given point during sequential output thereof.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
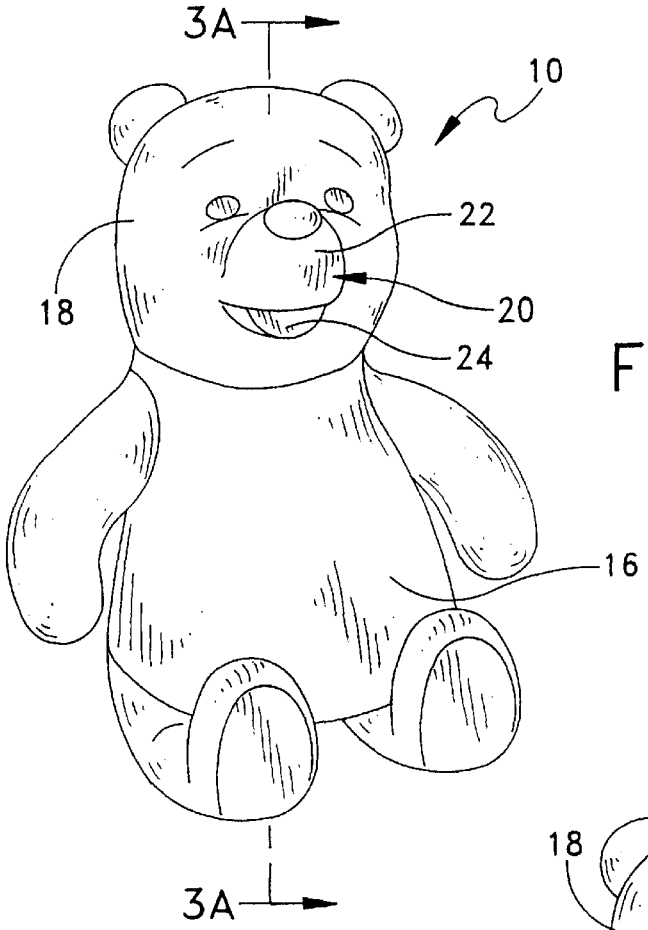
FIG. 1 is a perspective view of a toy figure constructed in accordance with the teachings of the present invention.

Referring now to the drawings, the electronic toy of the instant invention is illustrated and generally indicated at 10 in FIGS. 1–4. As will hereinafter be more fully described, the instant invention provides an improved technology that allows a child to more easily control the sound output and motion of a toy to achieve convincing and coordinated sound effects without highly sophisticated motor skills.

The basic concept behind the invention is an electronic toy 10 including a speech or sound generation device (speech processor, Voice ROM etc.) generally indicated at 12 that is provided with two or more parallel tracks of syllable level sound elements, each track independently forming a recognizable sound recitation, such as an entire song, verse, nursery rhyme, sound effect, joke, etc., when the individual elements are output in sequence. The content is preferably divided into small syllable level chunks and preferably comprises any vocalization or sound output that incorporates an instinctive, inherent rhythm, although the instinctive rhythm may not be critical to functionality in certain embodiments. In some cases, however, the content may be divided at the word level depending, for example, on the cadence and rhythm of the output.

Figure 5A:
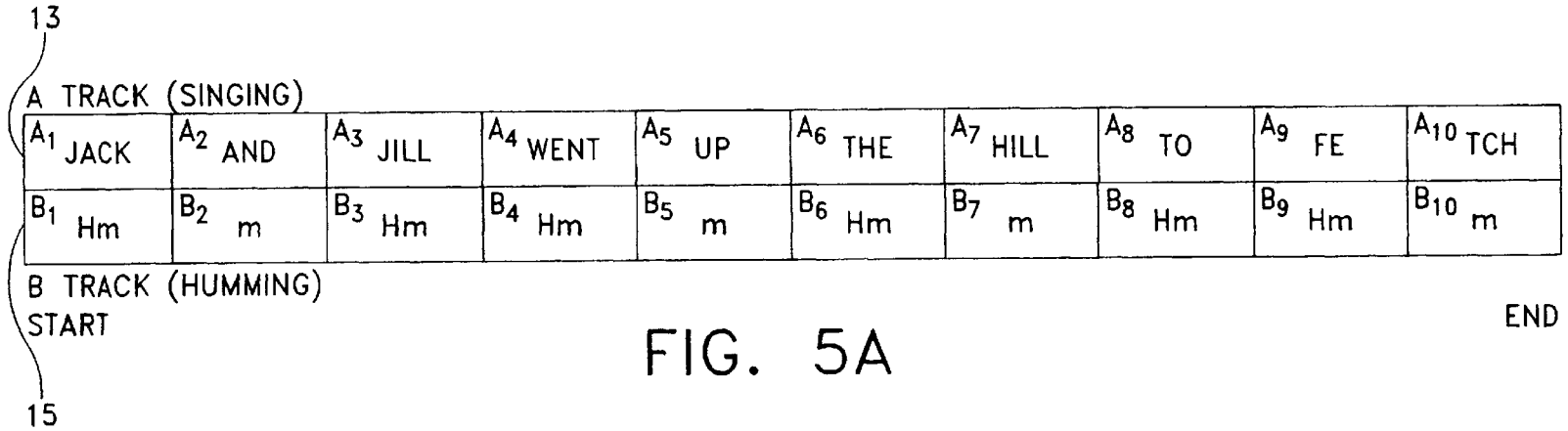
FIG. 5A is a schematic illustration of sequenced output of the parallel sound track according to a second mode of operation.
Figure 5B:
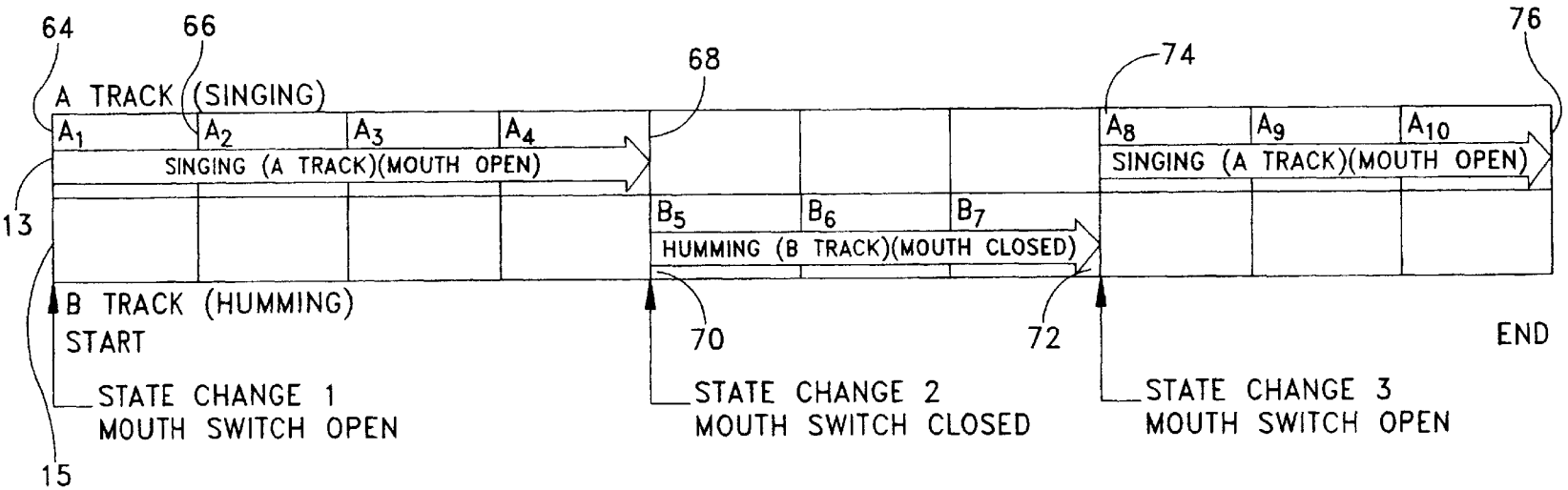
FIG. 5B is another schematic illustration of the sound elements showing switching of the tracks as the mouth switch changes state.

More specifically, referring to FIGS. 5A and 5B, the speech generator 12 is provided with a first track (Track A) 13 of sequenced sound elements A1–A10, that form a recognizable sound recitation, such as singing a nursery rhyme or song, when sequentially generated, and is, further provided with a second track (Track B) 15 of a like number of sequenced sound elements B1–B10, also forming a recognizable sound recitation, such as a humming version of the same nursery rhyme or song, when sequentially generated. Likewise, the two tracks 13, 15 could be the same song sung in two different voices, or could comprise two different sound effects. The possible combinations and permutations are essentially limitless. Of primary importance to the functionality of the invention is that the Track B 15 is related to Track A 13 in syllable level breakdown such that sound elements from the first and second tracks 13, 15 are interchangeable at any given point during sequential output thereof, i.e. Track B4 is interchangeable with Track A4 within the sequenced output. The sound generator 12 is connected to an input switch generally indicated at 14, which provides an input signal that initiates a sequenced sound output upon an initial change of state, and that determines from which track, A Track 13 or B Track 15, to output sound elements at a given time depending on the state of the switch. The end result is the ability of the toy to seemlessly switch from one track to the other without breaking verse or rhythm depending on the state of the switch, i.e. position of an appendage or movable element attached to the switch. Alternatively, the device could have multiple input switches, wherein a first switch is operative for initiating the output sequence, and a second switch is operative to control output from the respective tracks (track switching).

The remainder of the detailed description of the present electronic toy 10 will proceed in the context of a toy figure or character having mechanical mandible apparatus that allows proportional movement of the mouth to simulate speech. While this particular construction is illustrated and defined as a preferred embodiment, it is to be expressly understood that other embodiments of other types of electronic toys are also contemplated. Such other embodiments may include toy vehicles, machinery, tools, any of which might include a moving appendage, body part, element or implement to which a switch or other type of state device can be attached to detect position and or movement of the same.

Figure 2:
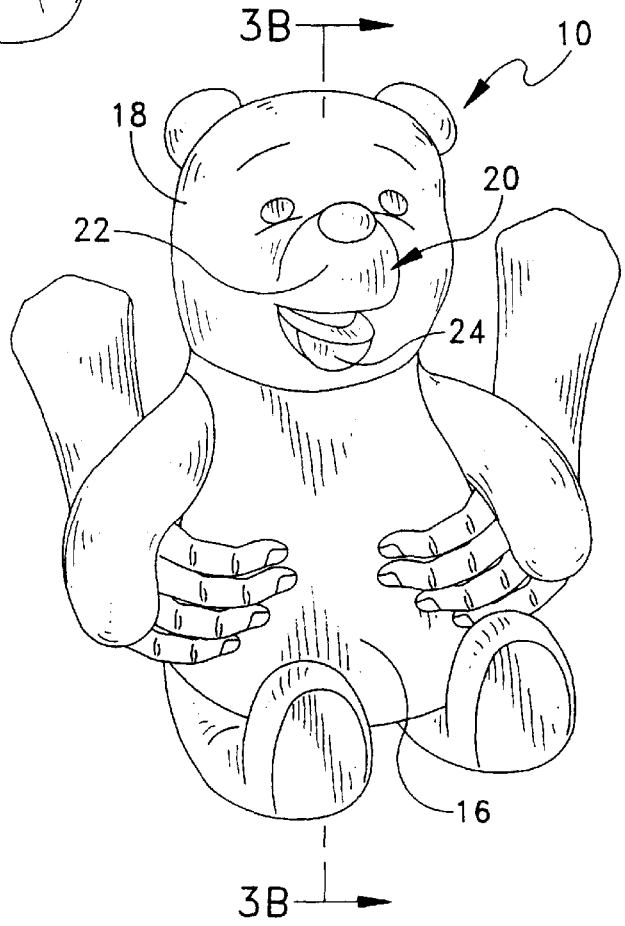
FIG. 2 is another perspective view showing a user manually squeezing the stomach of the toy to open its mouth.
Figure 3A:
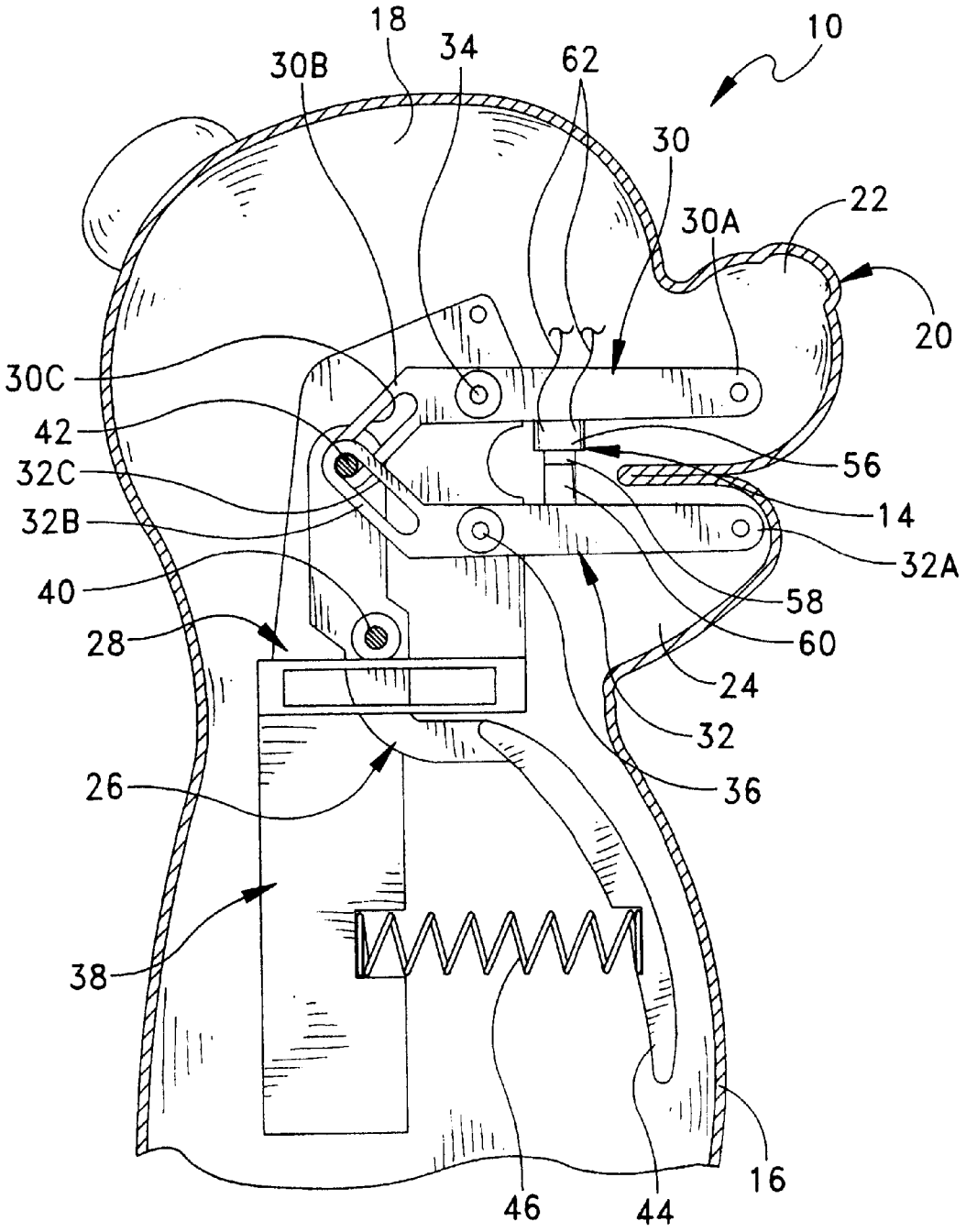
FIG. 3A is a cross-sectional view thereof with the mouth closed.
Figure 3B:
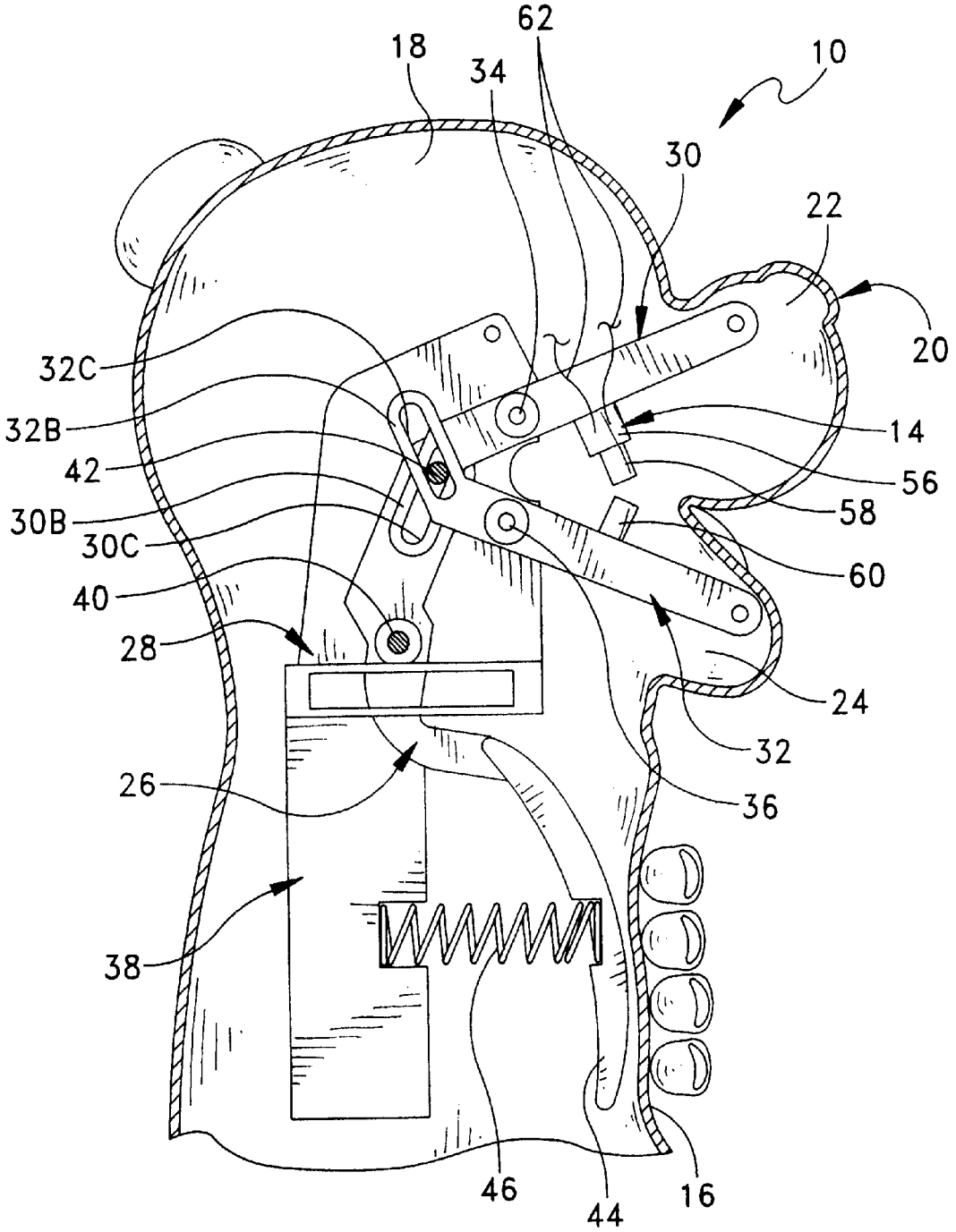
FIG. 3B is another cross-sectional view thereof with the mouth open.

The electronic toy 10 includes a housing (base unit) 11 configured in the shape and appearance of a toy teddy bear. The bear 11 included a main body portion 16, a head portion 18, and a mouth portion 20. The mouth portion 20 includes upper and lower jaw portions, 22, 24 respectively, that are independently movable relative to each other. Disposed within the toy 10 and spanning between the body portion 16 and the head portion 18 is an actuator assembly generally indicated at 26 (FIGS. 3A and 3B), that is operable for moving the upper and lower jaw portions 22, 24 responsive to the squeezing of the body portion 16 (FIGS. 2 and 3B).

The actuator assembly 26 comprises a frame generally indicated at 28, upper and lower opposable jaw members 30, 32 respectively, pivotably mounted on pins 34, 36 to the frame 28 in spaced relation, and an actuator lever 38 also pivotably mounted on pin 40 to the frame 28. Each of the jaw members 30, 32 includes a terminal end portion 30A, 32A which is received into the respective jaw portion 22, 24 of the toy bear 11 for controlling movement of the jaw and a proximal actuator end 30B, 32B, having an elongate slot formed 30C, 32C formed therein. The jaw members 30, 32 are movable between a closed position (FIG. 3A) wherein the jaw members 30, 32 are in generally parallel spaced relation, and an open position (FIG. 3B) wherein the jaw members 30, 32 are angled apart A pin 42 mounted on the upper end of the actuator level 38 extends through both slots 30C, 32C to control synchronized movement of both the jaw members 30, 32. The lower end of the actuator lever includes a handle portion 44 which is normally biased to an extended position corresponding to the closed position of the jaw members (FIG. 3A). The bias position is maintained by a coil spring 46 captured between the handle 44 and the frame 28. Inward actuation of the handle portion 44 pushes the pin 42 forward and rotates the jaw members 30, 32 to their open position (FIG. 3B). Proportional inward and outward movement of the handle portion 44 causes a corresponding proportional movement of the jaw members 30, 32 suitable for simulating mouth movements seen during speech. Alternatively, the actuator assembly 26 could be biased in the opposite direction wherein squeezing of the actuator handle forced the mouth closed rather than open.

Figure 4:
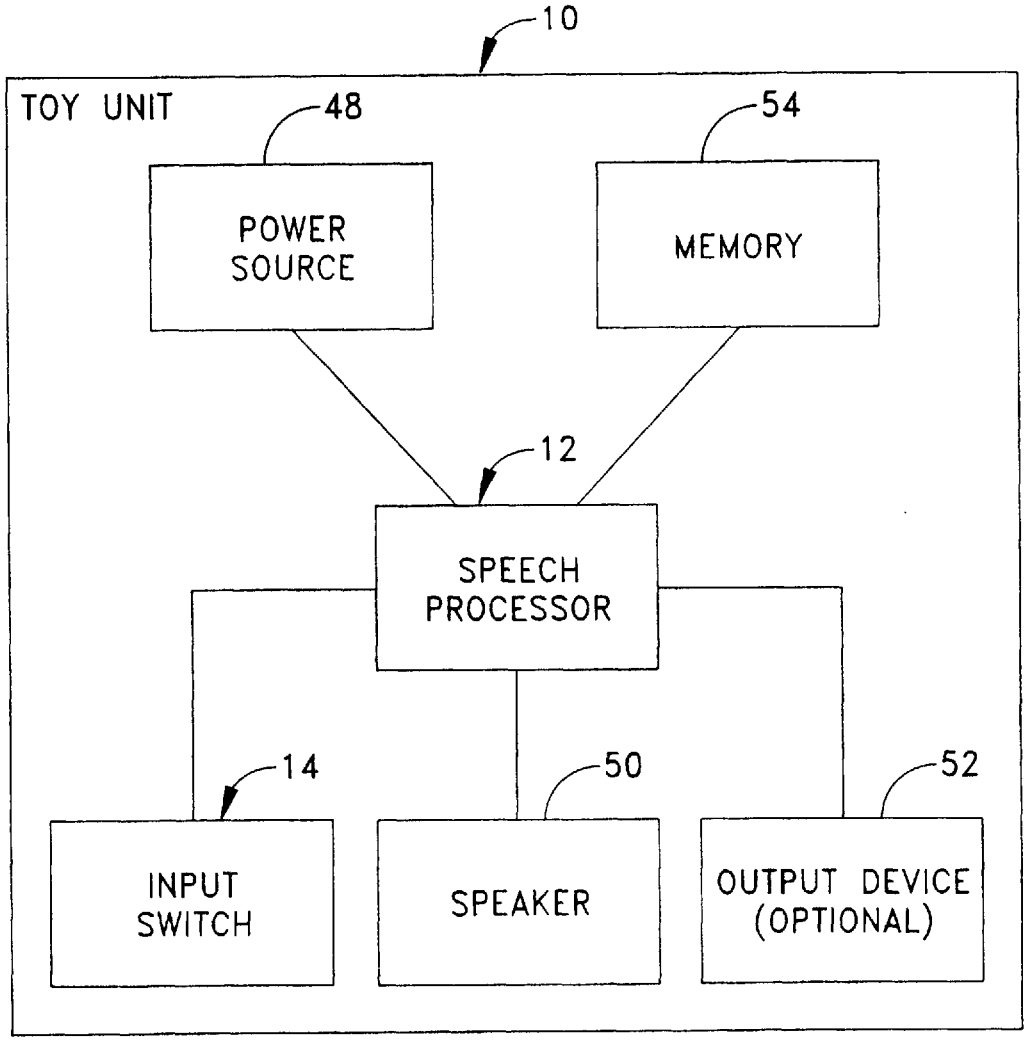
FIG. 4 is a schematic block diagram of the electronic module of the toy.

Turning to FIG. 4, the electronics module of the toy 10 further includes a power source 48, a speaker 50, and an optional output device 52, such as a light, motor, etc., some electrical device which can be controlled by an output from the speech processor 12. The power source 48 preferably comprises a battery power source having sufficient voltage and amperage to power all of the electronic components of the device. The speaker 50 is conventional in the art. The speech generation device 12 comprises any electronic device which is capable of generating an audible sound effect, either from a local (on-board) memory or external memory 54. Examples of suitable speech generating devices include, but are not limited to speech chips, such as an EM572xx speech voice ROM or a Winbond W528x speech voice ROM. Other types of speech or audio generators suitable for the present application include, but are not limited to, dual tone generators, and other like devices. For purposes of the application, the term sound generator is indicated as a generic definition of all such sound generating devices. The types of speech chips contemplated herein are well known in the art, and are not believed to require further detailed description as to functionality or programming techniques. The speech chip 12 preferably includes an on-board memory, or external memory 42, or both, that store the sound elements for an entire song, verse, nursery rhyme, joke, etc. In the context of the present invention, the speech generator 12 is provided with two parallel tracks 13, 15 of sound elements A1–A10, B1–B10 which can be interchangeably accessed by the speech generator during operation. As described hereinabove, the speech generator 12 is provided with a first track (Track A) 13 of sequenced sound elements that form a recognizable sound recitation, such as a nursery rhyme or song, when sequentially generated, and is further provided with a second track (Track B) 15 of a like number of sequenced sound elements also forming a recognizable sound recitation, such as a humming version of the same nursery rhyme or song, when sequentially generated. For purposes of describing the preferred embodiment, the two parallel tracks 13, 15 comprise the nursery rhyme Jack and Jill which is sung in the first track 13, and hummed in the second track 15.

The input device 14 preferably comprises a switch, such as a plunger switch 56 located on upper jaw members 30. When the jaw members 30, 32 are in the closed position, the plunger 58 of the switch 56 is closed by an actuator pin 60 on the lower opposing jaw 32, thus defining a closed circuit state. When the jaw members 30, 32 are open, the plunger 58 is released representing an open circuit state. Alternatively, any other electronic device which can indicate at least two different states, i.e. open or closed would be suitable within the context of the invention. The switch contacts 62 are connected to inputs in the speech generator 12 to provide input as to the mouth position, i.e. open or closed. It is important to note that for the disclosed embodiment, the type of switch device utilized should be operative for generating a state signal upon initial actuation, i.e. the change of state should be indicated at the beginning of the throw of the switch rather than at the end of the throw. In this regard, the state change will be indicated at the beginning of any movement. However, it may be desirable to utilize other types of switches which delay state changes for other applications.

In another configuration, a series of switches are utilized to correlate the degree to which the mouth is open rather than a simple open or closed position. Such an arrangement could be used to control volume of the output. For example, the sound output would be a lower volume (whisper) if the mouth were only partially open (only a few switches open—or closed), and would be a louder volume (shouting) if the mouth were completely open (all switches open—or closed).

Figure 6:
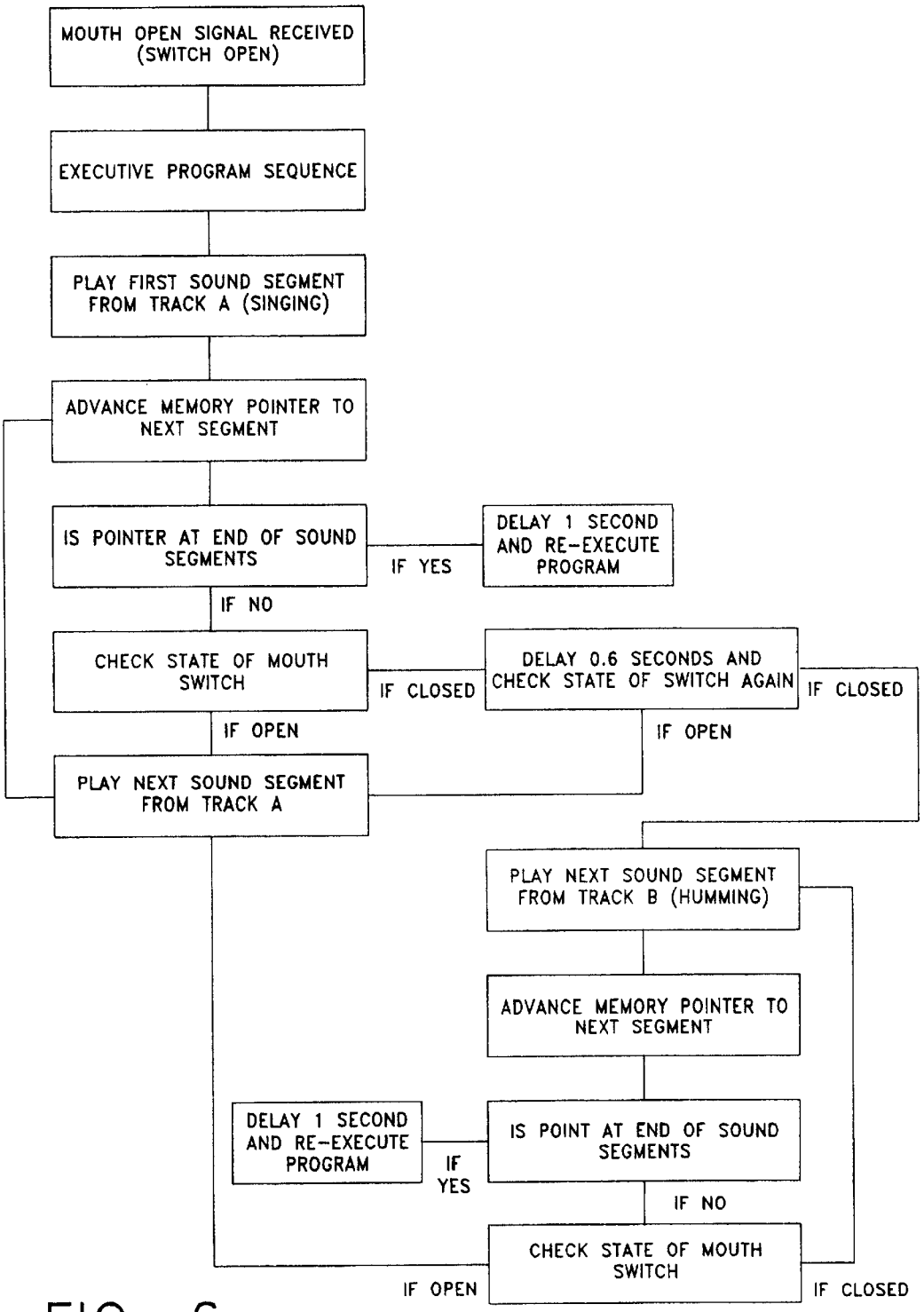
FIG. 6 is a flow chart showing a typical operation of the toy in a second mode of operation.

In operation, the toy 10 begins to talk or sing when its body portion 16 (belly) is first squeezed (see FIG. 6 flow chart). The squeezing action operates the actuator assembly 26 that opens the mouth 20, which in turn changes the state of switch 56 and initiates an output sequence from the speech generator 12. As indicated above, initiation of the sequence could also be controlled by a separate switch located elsewhere on the toy, for example, in the hand. When the mouth 20 is open, the child is able to easily control and vary the character's mouth position by varying the pressure on the handle 44 of the actuator assembly 26, thus mimicking the speech output generated by the speech generator 12. The speech generator 12 advances the sequence to the next sound element and checks the state of the mouth switch 56. Alternatively, the speech generator 12 could advance through several segments before checking the state of the switch. This could be advantageous in certain circumstances where a certain rhythm is desired. If the speech generator 12 senses that the mouth 20 is closed, the speech generator 12 initially pauses and then rechecks the switch 56. The pause is an important timing feature of the methodology in that it allows a brief natural closure of mouth, i.e. a normal hesitation, without automatically switching over to humming. If the mouth 20 is still closed after the pause, the sound generator 12 switches tracks to output the next corresponding humming segment (B Track 15) in the sequence of the song. In other words, the toy automatically stops singing and continues the song in a humming mode. The speech generator 12 continues to check the state of the switch 56, and if the mouth 20 is reopened, the sound generator 12 switches back to the singing track 13 (A Track) and the character begins to sing again at the same point within the sequenced output. Since the tracks 13 and 15 are interchangeable, the output appears as a continuous stream of singing and humming of the same song. If the switch 56 is maintained in a closed position for an extended period of time, the speech generator 12 will automatically reset the program sequence to the beginning.

Figure 6A:
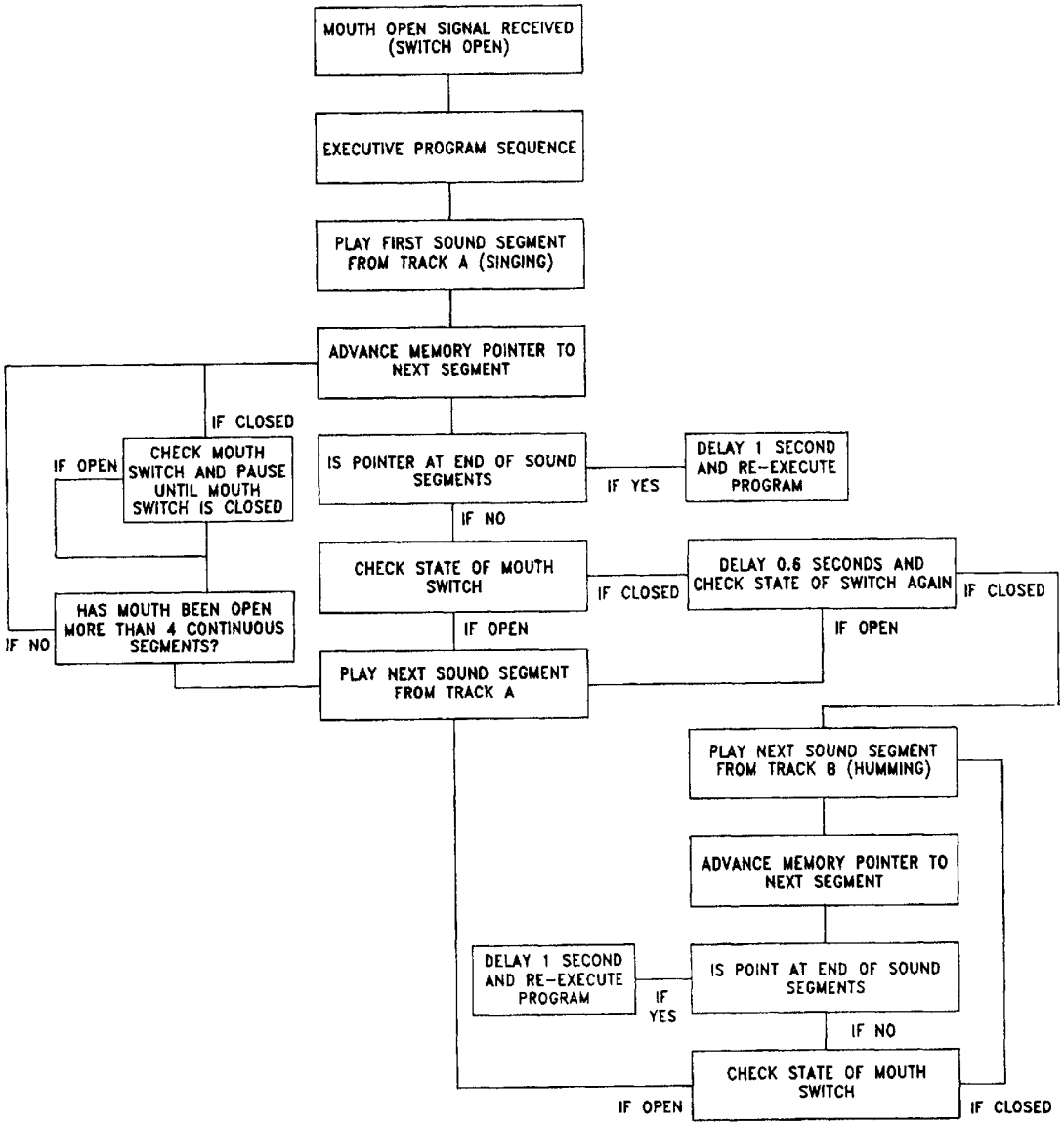
FIG. 6A is a flow chart showing an alternate operation of the toy.

Referring to FIG. 6A, a subroutine is added to force periodic closure of the mouth during operation. This subroutine prevents the user from simply squeezing the belly and holding it in the same position. In the illustrated example, a closed switch subroutine would check to see if the mouth switch had been detected in the closed position within the last four output segments. If the mouth had been sensed closed, operation would continue normally. However, if the mouth had not been sensed closed, the sequence would temporarily pause until the sound generator sensed that the mouth had been closed. If the mouth continuously remained open, the sound generator would reset. Other potential operating subroutines include requiring the state of the switch to be first sensed in a first position and then in a second position before generating the next sound element, i.e. requiring opening and closing of the mouth. In addition, another subroutine could reset the sound element pointer back to the beginning, if the state change is not detected within a given time period, or time delay.

EXAMPLE

Referring back to FIG. 5B, and proceeding according to the flow chart in FIG. 6, the program sequence begins at (64). Output is initiated by opening of the mouth 20 (STATE CHANGE 1). The speech generator 12 then checks the state of the mouth switch 56 (open), and outputs the first sound element A1 (Jack) from Track A (singing track). The speech generator 12 advances the sequence one element to (66) and thereafter checks the state of the switch 56 to determine output. In the example, the mouth thereafter remains open for output of four sequential segments A1–A4, i.e. "Jack and Jill went . . . ". After outputting the fourth segment A4 "went" (68), the mouth is closed (STATE CHANGE 2). Upon sensing that the switch 56 is closed, the speech generator 12 initiates a delay and rechecks the switch. (The delay is effective for spacing out the change over to humming so that the change over is not abrupt and unnatural.) Sensing that the switch is still closed, the speech generator 12 switches, to Track B (humming track) and outputs track B5 (70). The mouth 20 is sensed in the closed position for the next three sequences, and thus the speech generator outputs humming elements B5, B6 and B7 (up the hill). After the seventh element (72), the mouth 20 is reopened (STATE CHANGE 3), the speech generator 12 senses the open switch signal and switches output back to the A track. The mouth is sensed in the open position for the next three sequenced elements A8, A9, A10 (76).

Figure 7A:
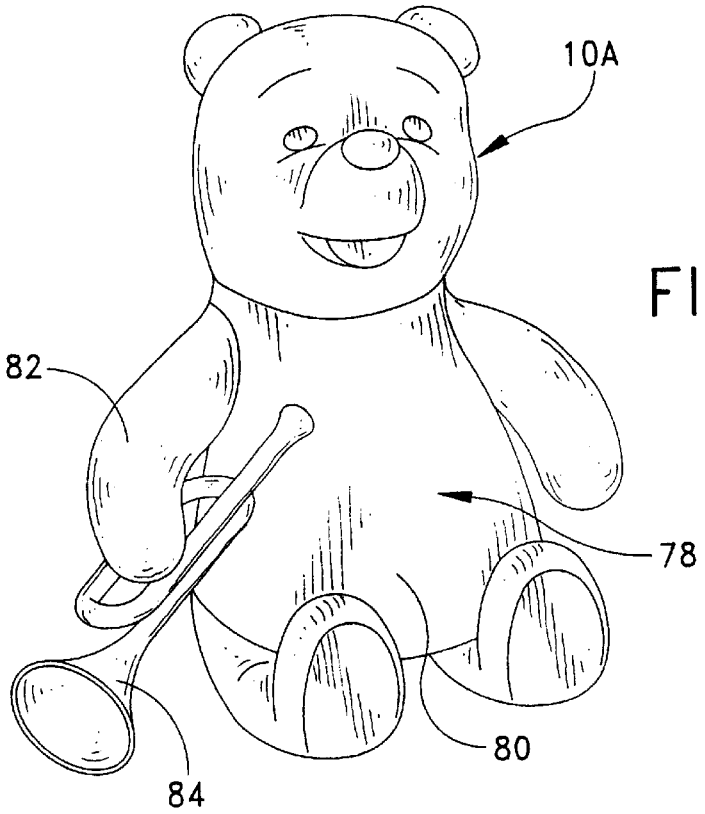
FIG. 7A is a perspective view of an alternative embodiment of the toy having a trumpet.
Figure 7B:
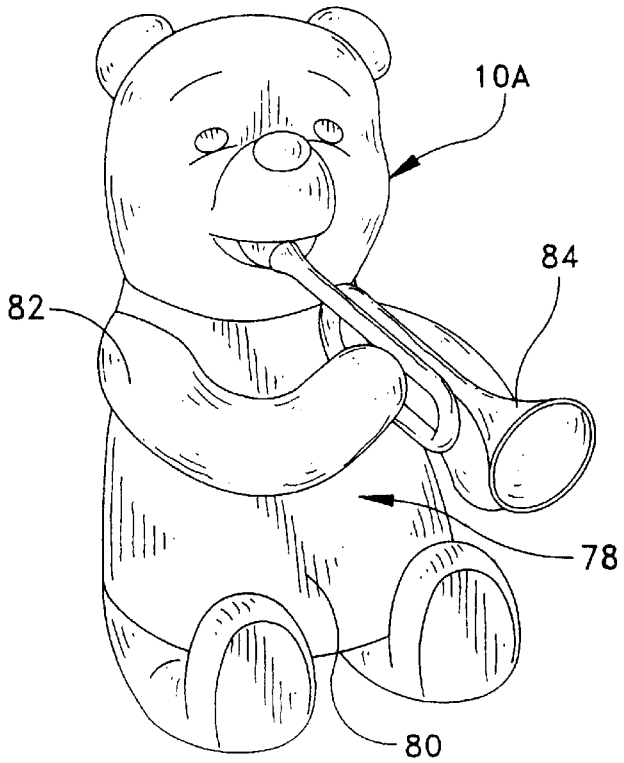
FIG. 7B is another perspective view thereof showing movement of the arm with the trumpet to the toy's mouth to simulate playing of the trumpet.
Figure 8:
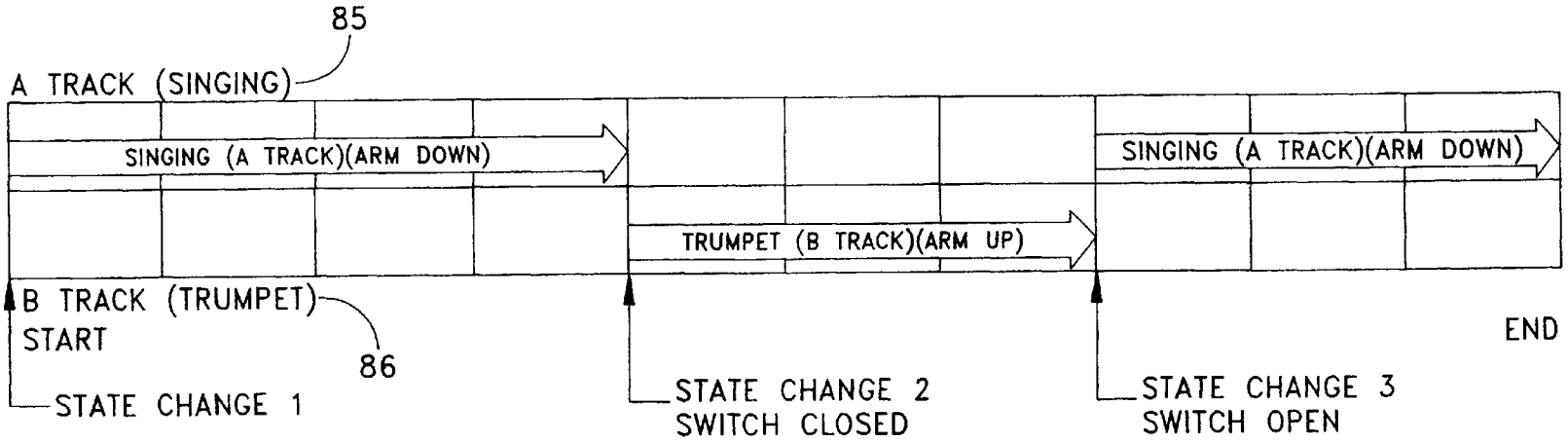
FIG. 8 is a schematic illustration of the sound elements showing switching of the tracks from singing to trumpet playing as the arm switch changes state.

Other embodiments, such as interchangeable music and singing, or overlapping singing and music are also contemplated. For example, referring to FIGS. 7 and 8, the toy 10A is constructed in the form of a tumpet playing bear 78. The bear 78 has a body portion 80, an arm 80 that is movable relative to the body portion, and a toy trumpet 82. The arm 82 is movable between a first lowered position (FIG. 7A), wherein the trumpet 84 is positioned away from the bear's mouth, and a second raised position (FIG. 7B), wherein the arm 82 is raised and the trumpet 84 is positioned in front of the bear's mouth. The sound generator 12 is provided with dual tracks of singing (A Track) 85 and trumpet playing (B Track) 86 (See FIG. 8) that are interchanged depending on the state of a switch (not shown) that senses the position of the bear's arm 82 relative to the body portion 80. Referring to FIGS. 7A, 7B, and 8) When the arm 82 is lowered (FIG. 7A) (state change 1), i.e. trumpet 84 away from the mouth, the speech generator 12 outputs Track A singing. When the arm 82 is raised (state change 2), trumpet to the mouth, the speech generator 12 outputs Track B trumpet playing in the continued sequence of the song. When the arm 82 is again lowered (state change 3), the speech generator 12 switches back to singing output.

Figure 9:
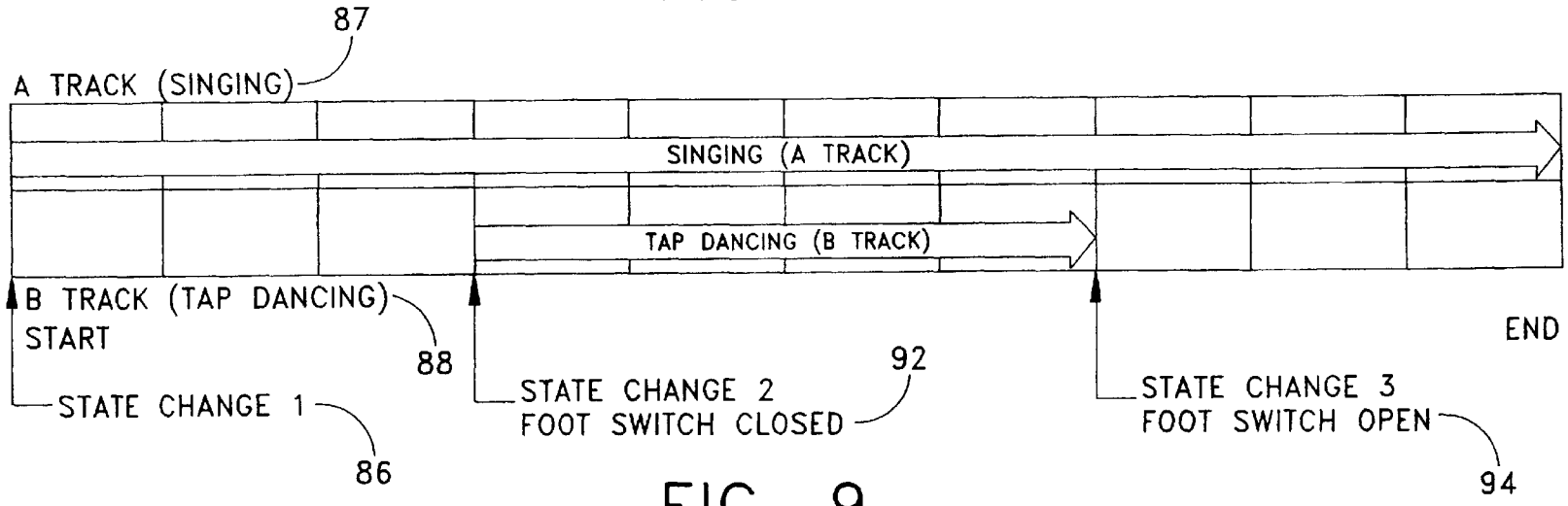
FIG. 9 is a is a schematic illustration of the sound elements showing dual output of the tracks from singing to singing and tap dancing as the foot switch changes state.

In yet another embodiment, the speech generator 12 comprises a dual tone or dual channel output device which is operative for simultaneously outputting, i.e. overlapping, parallel track elements. For example, referring to FIG. 9, the speech generator 12 would be provided with a first singing track (Track A) 87, and a second track 88 which has accompanying tap dancing. Upon initiation of the program sequence (state change 1) 90, the figure would begin to either sing, or alternatively output a musical score. Upon further actuation of the same switch, or other switches in the feet of the figure, i.e. by bouncing the feet of the figure on the ground (state change 2) 92, simulating tap dancing, the speech generator 12 would simultaneously output both the musical track and the accompanying coordinated tap dancing track to provide a unique overall audio effect (See FIG. 9). If no further activity is sensed in the foot switches, i.e. switch open, (state change 3) 94, the speech generator would switch back to singing only.

It can therefore be seen that the instant invention provides an improved electronic toy that allows a child to more easily control the sound output and motion of a toy figure to achieve convincing and coordinated sound effects without highly sophisticated motor skills. The provision of a movable mouth assembly coupled to an actuator in the belly area of the figure, and a switch correlated to the mouth position, allows the toy to be operated by a small child to effectively simulate speech output without sophisticated motor skills. The further provision of parallel sound tracks that each independently form a recognizable sound recitation, closely relating the tracks such that sound elements from the first and second tracks are interchangeable at any given point during sequential output thereof, and automatically switching between parallel tracks of sound elements responsive to the state of an input switch provides the toy with unique functionality and the appearance that the toy is acting on its own accord with user intervention. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A method of operating an electronic toy comprising a base unit having a switch, and an electronic sound generator, said method comprising the steps of:

(a) electronically storing a first track of sequenced sound elements in said electronic sound generator, said first track of sequenced sound elements forming a first recognizable sound recitation when sequentially generated, and electronically storing a second track of sequenced sound elements in said electronic sound generator, said second track of sequenced sound elements forming a second recognizable sound recitation when sequentially generated, said first and second sound recitations being interchangeably related wherein said first and second sound recitations comprise alternative recitations of a common sound recitation, said sound elements of said first track and said sound elements of said second track being equal in number, said sound elements of said second track being interchangeably related to said sound elements of said first track such that corresponding sound elements from said first and second tracks are interchangeably playable on the electronic sound generator at any given point during sequential output thereof, each of said sound elements from said second track having an equal time duration as said corresponding sound elements from said first track so as to maintain a consistent output cadence during playback, said electronic sound generator being connected to said switch;

(b) initiating a program for controlling said electronic sound generator to produce a sequenced output of said sound elements, wherein said program is operative for controlling the steps of;

(c) generating an initial sound element from said first track if said switch is in a first state;

(d) generating an initial sound element from said second track if said contact switch is in a second state;

(e) checking the state of the switch after said initial sound element is output;

(f) generating the next sequential sound element from said first track if said switch is in said first state, and generating the next sequential sound element from said second track if said switch is in said second state; and (g) continuously repeating steps (e) and (f) whereby the toy is operable for generating a sound recitation that selectively alternates, on a sound element by sound element basis, from said first version thereof to said second version thereof responsive to a current state of said switch.

2. The method of claim 1 further comprising the step of initiating a time delay after the switch is first sensed in the second state, and then checking the state of the contact switch a second time after the time delay.

3. The method of claim 1 further comprising the step of initiating a time delay after the last sound element of either the first or second tracks is generated.

4. The method of claim 1 further comprising the step of requiring the switch to be sensed in a given state at a given element so that the output is not automatically continuous without some actuation by the operator.

5. The method of claim 1 further comprising the step of requiring the switch to be in a first state, and then in an opposite second state before generating the next sound element.

6. The method of claim 5 further comprising the step of resetting the sequence of sound elements to the first sound element if a transition in state from said first state to said second state does not occur within a given time period.

7. The method of claim 1 wherein said first track comprises singing sound elements of a song, and said second track comprises interchangeable humming sound elements of the same song.

8. The method of claim 1 wherein said first track comprises singing sound elements of a song, and said second track comprises interchangeable music sound elements of the same song.

9. A method of operating an electronic sound generator for a toy comprising the steps of:

(a) providing an electronic sound generator having a first track of sequenced sound elements electronically stored therein, said first track of sequenced sound elements forming a first recognizable sound recitation when sequentially generated, said electronic sound generator further having a second track of sequenced sound elements electronically stored therein, said second track of sequenced sound elements forming a second recognizable sound recitation when sequentially generated, said first and second sound recitations being interchangeably related wherein said first and second sound recitations comprise alternative recitations of a common sound recitation, said sound elements of said first track and said sound elements of said second track being equal in number, said sound elements of said second track being interchangeably related in one to one correspondence to said sound elements of said first track such that corresponding sound elements from said first and second tracks are interchangeably playable on the sound generator at any given point during sequential output thereof, each of said sound elements from said second track having an equal time duration as said corresponding sound elements from said first track so as to maintain a consistent output cadence during playback, said electronic sound generator being connected to a switch in a toy;

(b) initiating a program for controlling said electronic sound generator to produce a sequenced output of said sound elements, wherein said program is operative for controlling the steps of;

(c) generating an initial sound element from said first track if said switch is in a first state;

(d) generating an initial sound element from said second track if said switch is in a second state; and (e) checking the state of the switch after said initial sound element is output;

(f) generating the next sequential sound element from said first track if said switch is in said first state, and generating the next sequential sound element from said second track if said switch is in said second state;

(g) continuously repeating steps (e) and (f) whereby the toy is operable for generating a sound recitation that selectively alternates, on a sound element by sound element basis, from said first version thereof to said second version thereof responsive to a current state of said switch.

10. The method of claim 9 further comprising the step of initiating a time delay after the switch is first sensed in the second state, and then checking the state of the switch a second time after the time delay.

11. The method of claim 9 further comprising the step of initiating a time delay after the last sound element of either the first or second tracks is generated.

12. The method of claim 9 further comprising the step of requiring the switch to be sensed in a given state at a given element so that the output is not automatically continuous without some actuation by the operator.

13. The method of claim 9 further comprising the step of requiring the switch to be in a first state, and then in an opposite second state before generating the next sound element.

14. The method of claim 13 further comprising the step of resetting the sequence of sound elements to the first sound element if a transition in state from said first state to said second state does not occur within a given time period.

15. The method of claim 9 wherein said first track comprises singing sound elements of a song, and said second track comprises interchangeable humming sound elements of the same song.

16. The method of claim 9 wherein said first track comprises singing sound elements of a song, and said second track comprises interchangeable music sound elements of the same song.

17. The method of claim 9 wherein said first track comprises singing sound elements of a song, and said second track comprises interchangeable tapping sound elements of the same song.

18. A method of operating an electronic sound generator comprising the steps of:

(a) electronically storing a first track of sequenced sound elements in said electronic sound generator, said first track of sequenced sound elements forming a first recognizable sound recitation when sequentially generated;

(b) electronically storing a second track of sequenced sound elements in said electronic sound generator, said second track of sequenced sound elements forming a second recognizable sound recitation when sequentially generated, said first and second sound recitations being interchangeably related wherein said first and second sound recitations comprise alternative recitations of a common sound recitation, said sound elements of said second track being interchangeably related in one to one correspondence to said sound elements of said first track such that corresponding sound elements from said first and second tracks are interchangeably playable on the electronic sound generator at any given point during sequential output thereof, each of said sound elements from said second track having an equal time duration as said corresponding sound elements from said first track so as to maintain a consistent output cadence during playback, said electronic sound generator being connected to a switch;

(c) initiating a program for controlling said electronic sound generator to produce a sequenced output of said sound elements, wherein said program is operative for controlling the steps of;

(d) generating an initial sound element from said first track if said switch is in a first state;

(e) generating an initial sound element from said second track if said switch is in a second state; and (f) checking the state of the switch after said initial sound element is output;

(g) generating the next sequential sound element from said first track if said switch is in said first state, and generating the next sequential sound element form said second track if said switch is in said second state; and (h) continuously repeating steps (f) and (g) whereby the toy is operable for generating a sound recitation that selectively alternates, on a sound element by sound element basis, from said first version thereof to said second version thereof responsive to a current state of said switch.

19. The method of claim 18 further comprising the step of initiating a time delay after the switch is first sensed in the second state, and then checking the state of the switch a second time.

20. The method of claim 18 further comprising the step of initiating a time delay after the last sound element of either the first or second tracks is generated.

21. The method of claim 18 further comprising the step of requiring the switch to be sensed in a given state at a given element so that the output is not automatically continuous without some actuation by the operator.

22. The method of claim 18 further comprising the step of requiring the switch to be in a first state, and then in an opposite second state before generating the next sound element.

23. The method of claim 22 further comprising the step of resetting the sequence of sound elements to the first sound element if a transition in state from said first state to said second state does not occur within a given time period.

24. The method of claim 18 wherein said first track comprises singing sound elements of a song, and said second track comprises interchangeable humming sound elements of the same song.

25. The method of claim 18 wherein said first track comprises singing sound elements of a song, and said second track comprises interchangeable music sound elements of the same song.

26. The method of claim 18 wherein said first track comprises singing sound elements of a song, and said second track comprises interchangeable tapping sound elements of the same song.

* * * * *